US006808010B2

(12) United States Patent
Dixon et al.

(10) Patent No.: US 6,808,010 B2
(45) Date of Patent: Oct. 26, 2004

(54) METHOD FOR TREATING CERAMIC CORES

(75) Inventors: Bobby A. Dixon, Morristown, TN (US); Jennifer A. Holt, Whitesburg, TN (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 09/805,426

(22) Filed: Mar. 13, 2001

(65) Prior Publication Data

US 2002/0129925 A1 Sep. 19, 2002

(51) Int. Cl.[7] ..... B22C 9/12
(52) U.S. Cl. ..... 164/520; 164/518; 164/369
(58) Field of Search ..... 164/28, 15, 6, 164/369, 520, 518

(56) References Cited

U.S. PATENT DOCUMENTS

| | | | | |
|---|---|---|---|---|
| 2,545,799 A | | 3/1951 | Snow | 22/10 |
| 2,671,969 A | | 3/1954 | Mayer | |
| 3,688,832 A | | 9/1972 | Horton | 164/72 |
| 3,888,299 A | | 6/1975 | Bardet | 164/228 |
| 3,994,333 A | | 11/1976 | Linneweh et al. | 164/157 |
| 4,073,609 A | | 2/1978 | Petrenchik | 425/442 |
| 4,093,017 A | | 6/1978 | Miller, Jr. et al. | 164/28 |
| 4,108,672 A | | 8/1978 | Klug et al. | 106/38.9 |
| 4,184,885 A | | 1/1980 | Pasco et al. | 106/73.4 |
| 4,241,779 A | | 12/1980 | Zitser et al. | 164/207 |
| 4,583,581 A | | 4/1986 | Ferguson et al. | 164/529 |
| 4,837,187 A | * | 6/1989 | Frank et al. | 501/127 |
| 4,844,141 A | | 7/1989 | Trumbauer et al. | 164/15 |
| 5,076,342 A | * | 12/1991 | Johansen | 164/137 |
| 5,697,418 A | | 12/1997 | Bardot et al. | 164/28 |

FOREIGN PATENT DOCUMENTS

| | | | |
|---|---|---|---|
| EP | 0914883 | | 5/1999 |
| GB | 1388273 | | 3/1975 |
| GB | 2 202 541 | | 9/1988 |
| JP | 57-146450 | * | 9/1982 |
| JP | 610176439 | | 8/1986 |
| JP | 3-97675 | * | 4/1991 |
| WO | 32331 | | 6/2000 |

* cited by examiner

*Primary Examiner*—Kiley Stoner
*Assistant Examiner*—Len Tran
(74) *Attorney, Agent, or Firm*—Edward J. Timmer

(57) ABSTRACT

A method for treating an unfired, molded ceramic core comprises placing an unfired (green) ceramic core having a thermosetting and/or thermoplastic binder on at least one setter, placing the setter and the green ceramic core thereon on a conveyor, conveying the setter and the green core through the heating oven to heat the setter and the green ceramic core to an elevated superambient temperature at or above a softening temperature of the binder present in the green core. Heating of the green ceramic core in this manner conforms the core to a surface of the setter to reduce distortion of the core and improve yields of cores that are within preselected dimensional tolerances.

10 Claims, 3 Drawing Sheets

METHOD FOR TREATING CERAMIC CORES

FIELD OF THE INVENTION

The present invention relates to a method for treating unfired (green) ceramic cores for use in casting molten metallic materials.

BACKGROUND OF THE INVENTION

Most manufacturers of gas turbine engines are evaluating advanced investment cast turbine airfoils (i.e. turbine blade or vane) which include intricate air cooling channels to improve efficiency of airfoil internal cooling to permit greater engine thrust and provide satisfactory airfoil service life. Internal cooling passages are formed in the cast airfoils using one or more thin airfoil shaped ceramic cores positioned in a ceramic shell mold where the molten metal is cast in the mold about the core. After the molten metal solidifies, the mold and core are removed to leave a cast airfoil with one or more internal passages where the cores formerly resided.

The ceramic core is typically made using a plasticized ceramic compound comprising ceramic flour, organic thermosetting and/or thermoplastic binder and various additives. The ceramic compound is injection molded or transfer molded at elevated temperature in a core die or mold. When the green (unfired) core is removed from the die or mold, it typically is placed between top and bottom setters to cool to ambient temperature before core finishing and gauging operations and firing at an elevated sintering temperature.

The green core can exhibit distortion from stresses induced in the core from the molding and/or ambient cooling operations. Distortion can be a particular problem with respect to the airfoil region of the core have a trailing edge with a relatively thin cross-section that is prone to distortion. As a result, the green ceramic cores can exhibit dimensional variations from one core to the next in a production run of cores. Moreover, the green core may be improperly contacted by the top or bottom setter such that dimensional variations from one core to the next occur in a production run.

An object of the present invention is to provide a method of treating an unfired ceramic core in a manner to reduce distortion of the core and improve yield of cores that meet dimensional tolerances.

SUMMARY OF THE INVENTION

In one embodiment of the invention, a method for treating an unfired ceramic core comprises placing an unfired (green) ceramic core having a molded core shape and a binder on at least one setter, placing the setter and the green ceramic core thereon on a conveyor, conveying the setter and the green core through the heating oven to heat the setter and the green ceramic core to an elevated superambient temperature. Heating of the green ceramic core in this manner conforms the core to a surface of the setter to reduce distortion of the core and improve yields of cores within preselected dimensional tolerances. To this end, the setter and the green ceramic core preferably are heated to a superambient temperature at or above a softening temperature of the binder present in the molded green core. Each of a plurality of green ceramic cores can be treated by placing the core on respective setter and placing each core/setter on the conveyor for transport through the heating oven one after another or side-by-side on the conveyor.

In a particular embodiment of the invention, the rate of travel of the conveyor through the heating oven is controlled such that the setter and the green ceramic core are heated to the desired superambient temperature proximate an exit opening of the heating oven. The setter and the green ceramic core are removed from the conveyor after exiting the heating oven so that the setter and the green ceramic core can cool to ambient temperature. The setter supplies heat to the green ceramic core after exiting the heating oven and during cooling to ambient temperature is advantageous to reduce the time needed to heat the green ceramic core in the heating oven.

In a preferred embodiment of the invention, the green ceramic core is placed between a top setter and a bottom setter and is conveyed through the heating oven between the top setter and bottom setter.

The invention is beneficial for, although not limited to, treating a green ceramic core that includes an airfoil region having a trailing edge with a relatively thin cross-section that is prone to distortion after removal from a core molding die.

DESCRIPTION OF THE INVENTION

The present invention is described herebelow for purposes of illustration only with respect to manufacture of ceramic cores made by conventional injection molding, transfer molding, or other core-forming techniques where a plasticized ceramic compound is introduced into a core die or mold. An injection or transfer molded ceramic core is molded by injecting the ceramic compound including ceramic powder (e.g. alumina, silica, zircon, zirconia, etc. fluor), an organic binder (e.g. a thermosetting binder material, thermoplastic or cross-linking thermoplastic binder material, and mixtures thereof) and various additives at elevated temperature into a die at superambient die temperature to form a green core. The particular ceramic powders, organic binder and additives comprising the ceramic compound can be selected from conventional materials available and used to this end and form no part of this invention.

A typical thermosetting resin binder that can be used is available as SR360 resin from General Electric Company and has a softening point or temperature above about 200 degrees F. (e.g. about 250 degrees F.) after the green core 10 is molded at elevated temperature (e.g. 300 degrees F.) . That is, the thermosetting resin binder cross-links to some extent during molding of the ceramic core to shape in the core die or mold, thereby raising its softening temperature above a lower value exhibited by the off-the-shelf resin binder. When the molded green core 10 is subsequently heated above the softening point or temperature of the binder present in the molded ceramic core 10, the binder will allow the green core 10 to be compliant and relax internal stresses and conform under weight of top setter 40 to surfaces 40*a*, 42*a* of rigid top and bottom setters 40, 42 to a desired core configuration. However, the invention is not limited to any particular thermosetting and/or thermoplastic resin binder as other organic binders that soften at an elevated superambient temperature can be used in practicing the invention. For example, U.S. Pat. No. 4,837,187 describes an alumina based core material including a thermoplastic wax-based binder system for injection into a core die to form a green core, the teachings of which patent are incorporated herein by reference.

Figure 1:
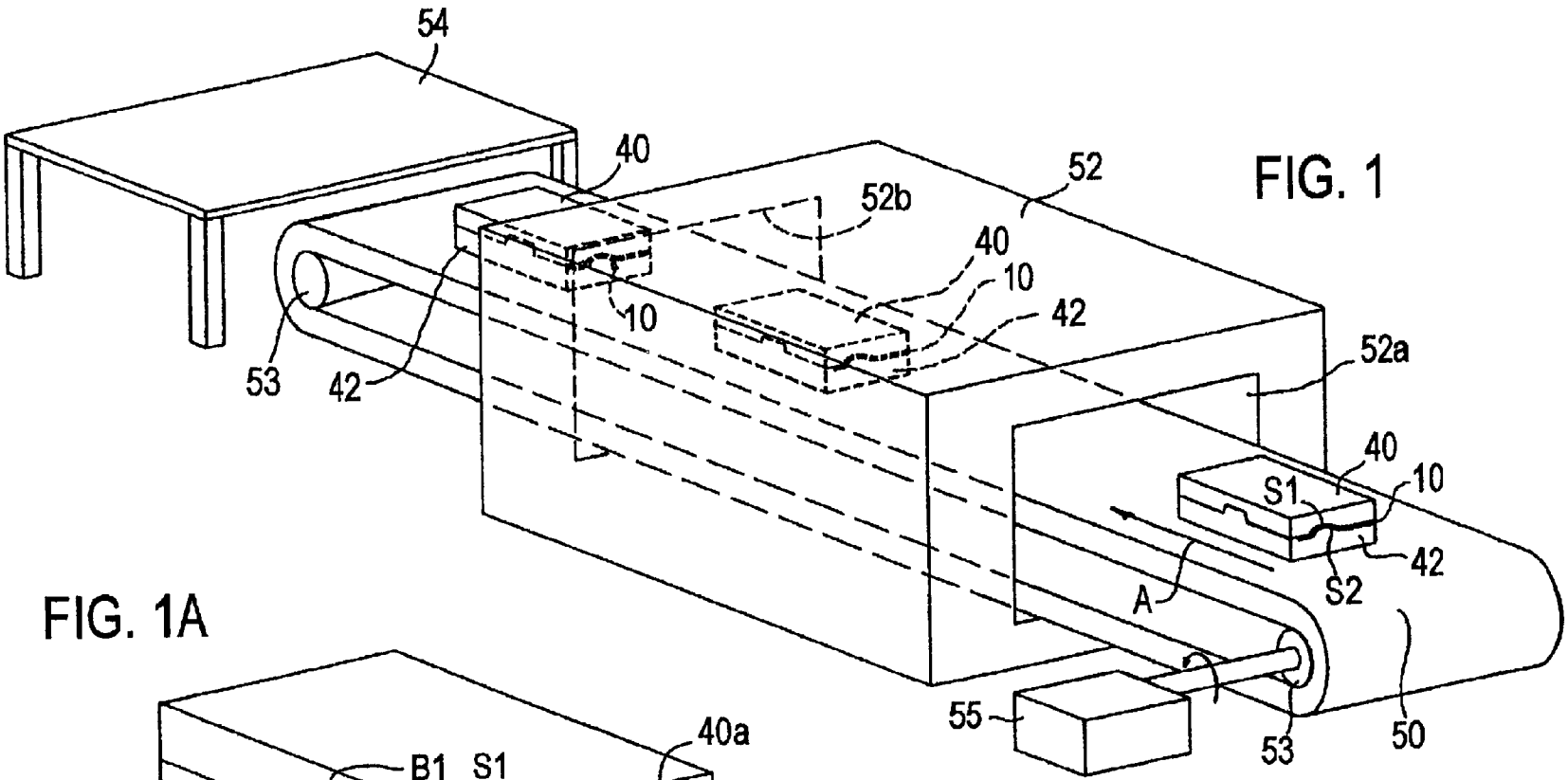
FIG. 1 is a schematic perspective view of apparatus for practicing a method of the invention.
Figure 1A:
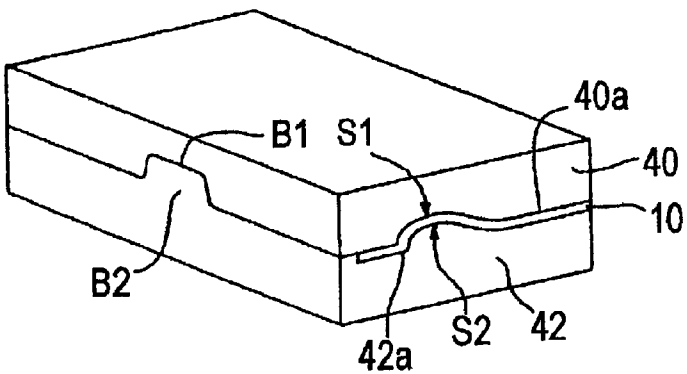
FIG. 1A is an enlarged view of the top and bottom setters with a green ceramic core therebetween.
Figure 2:
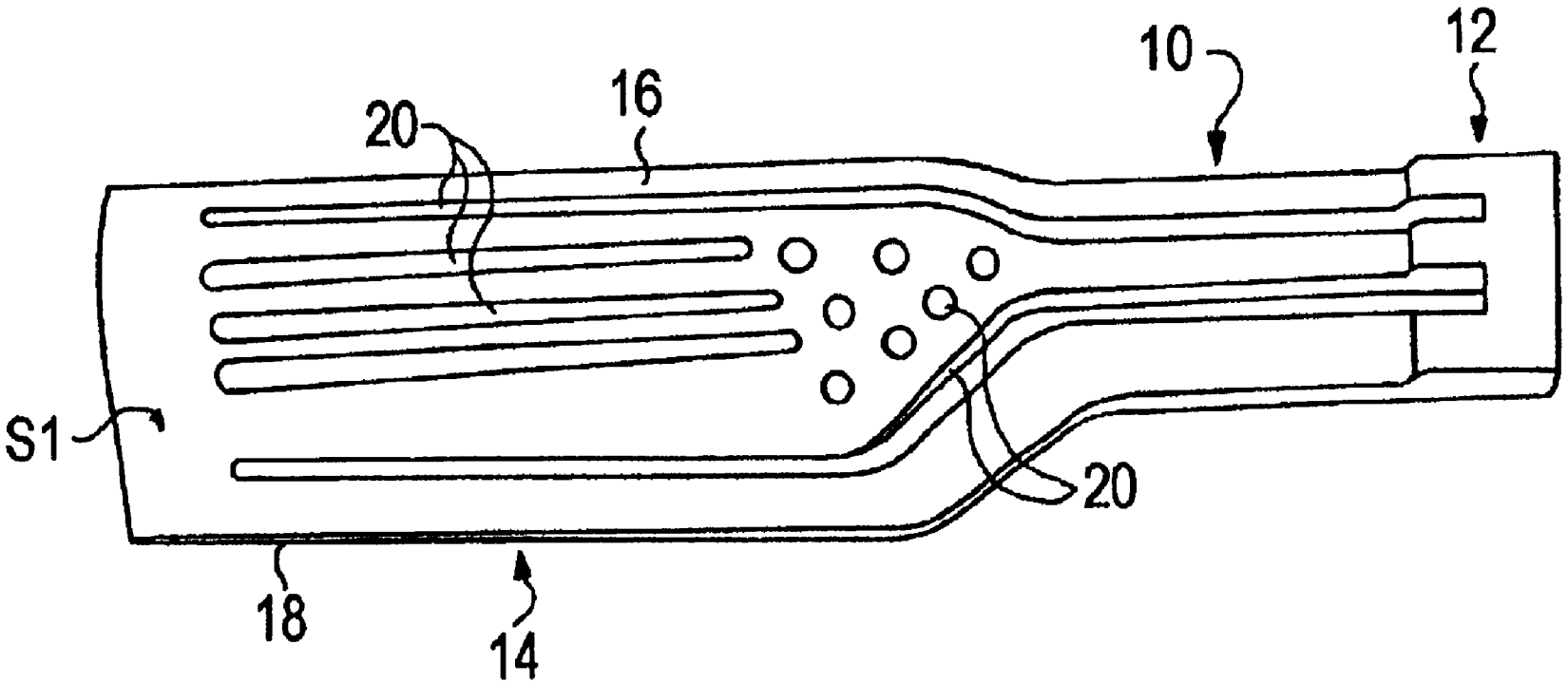
FIG. 2 is a perspective view of a typical green ceramic core that can be treated pursuant to the invention.

Referring to FIGS. 1 and 1A, a green ceramic core 10 removed from a core die or mold (not shown) is shown schematically positioned between top rigid setter 40 and bottom rigid setter 42. The green core 10 can be positioned between setters 40, 42 when it is still at an elevated molding temperature (e.g. 300 degrees F.) following removal from the core die or mold, or after the green core 10 cools to room temperature. An illustrative green ceramic core 10 for use in casting a nickel or cobalt base superalloy gas turbine engine blade is illustrated in FIG. 2. The core 10 has a configuration of internal cooling passages to be formed in the turbine blade casting. The core 10 is illustrated as comprising a root region 12 and an airfoil region 14. The airfoil region 14 includes a leading edge 16 and a trailing edge 18 having a relatively thin cross-section prone to distortion. Openings or slots 20 of various configurations and dimensions can be provided through the core 10 to form elongated walls, rounded pedestals, and other features in the interior of the cast turbine blade as well known. The core 10 includes a convex side S1 and an opposite concave side S2 as is well known in the turbine airfoil core art. The sides S1, S2 typically include complex surface features such as ribs, pedestals, turbulators, and the like. The trailing edge 18 typically tapers to a very thin edge that is prone to warp or curl or otherwise distort.

The rigid top and bottom setters 40, 42 may comprise metal, plastic (e.g. REN plastic available from Ciba Geigy Company), ceramic or other relatively rigid/stiff material. The setters include a respective inner core receiving surfaces 40*a*, 42*a* that correspond to the outermost profile or contour of the respective proximate sides S1, S2 of the green ceramic core 10 and define a cavity therebetween to receive the green core 10. The contoured setter surfaces 40*a*, 42*a* each is flat and does not include surface details, such as pedestals, turbulators, and the like, that are present on the molded core 10.

In practicing an embodiment of the method of the invention, a green ceramic core 10 is removed from the core die or mold (not shown) and placed on the bottom setter 42 while still hot from molding or after cooling to ambient temperature. Flash on the core surface or side S2 that could contact the setter surface 42*a* and interfere with proper positioning of the core on setter 42 is trimmed to permit proper location of the green core on the setter 42. Core flash can originate from parting lines in the core die. Alternately, the bottom setter 42 can be relieved at any suitable location (s) to accommodate any flash remaining on the core 10. The top setter 40 then is placed atop the core 10 in conventional manner. Flash on the core surface or side S1 that could contact the top setter surface 40*a* and interfere with proper positioning of the core on setter 40 is trimmed to permit proper location of the green core on the setter 40. Setters 40, 42 include one or more pairs of male and female locating buttons B2, B1, FIG. 1A, that mate with one another to positively locate the setters relative to one another with the core 10 therebetween. The top setter 40 is held on the green core 10 by gravity force, although a clamp mechanism (not shown) can be used to this end. Parameters such as setter weight, setter materials, clamp force, and the like can be chosen depending on the ceramic core material and core treating parameters employed.

The invention is not limited to use with both top and bottom setters 40, 42. For example, the top setter 40 may be optional and omitted so long as core 10 is placed and supported on at least one setter; i.e. bottom setter 42, particularly if the ceramic core material includes a thermoplastic binder.

In practicing an embodiment of the invention, the setters 40, 42 with green ceramic core 10 therebetween are positioned on an endless conveyor 50, FIG. 1, that travels through a conventional heating oven 52 such as an electrical resistant element-heated convection oven (e.g. similar to a pizza oven). The oven 52 includes an entry opening 52*a* and exit opening 52*b* aligned in the direction of conveyor movement illustrated by the arrow A in FIG. 1. The conveyor can comprise a conventional endless metal belt conveyor that revolves on rollers 53 and is driven by a motor 55 driving one or both of the rollers 53.

Each of a plurality of green ceramic cores 10 can be treated by placing the green core between respective setters 40, 42 and placing each setters 40, 42/core 10 assembly on the conveyor for transport through the heating oven 52 one after another as illustrated in FIG. 1. The setters 40, 42/core 10 are spaced apart in the direction of arrow A on the conveyor to provide more consistent heating and controlling the weight on the conveyor belt. For example, an end-to-end spacing of three inches (or other suitable distance) can be provided between adjacent setters 40, 42/core 10 on the conveyor 50. The setters 40, 42/core 10 also can be placed side-by side on the conveyor 50 with a lateral spacing normal to arrow A to this same end. The oven 52 typically is controlled by an operator pursuant to a schedule to where the convection oven fan is first turned on, then the conveyor 50 is turned on to a preselected speed, and then the oven heater is turned on for a preselected time (e.g. 10 minutes) to achieve a desired oven internal temperature before the operator begins loading setters 40, 42/core 10 one after another on the moving conveyor 50.

In a preferred embodiment of the invention, the rate of travel of the conveyor 50 through the heating oven 52 is controlled for a given oven internal temperature such that the setters 40, 42 and the green ceramic core 10 therebetween are heated to the desired superambient temperature above the softening temperature of the organic binder present in the molded green ceramic core 10 proximate exit opening 52*b* of the heating oven.

Figure 3:
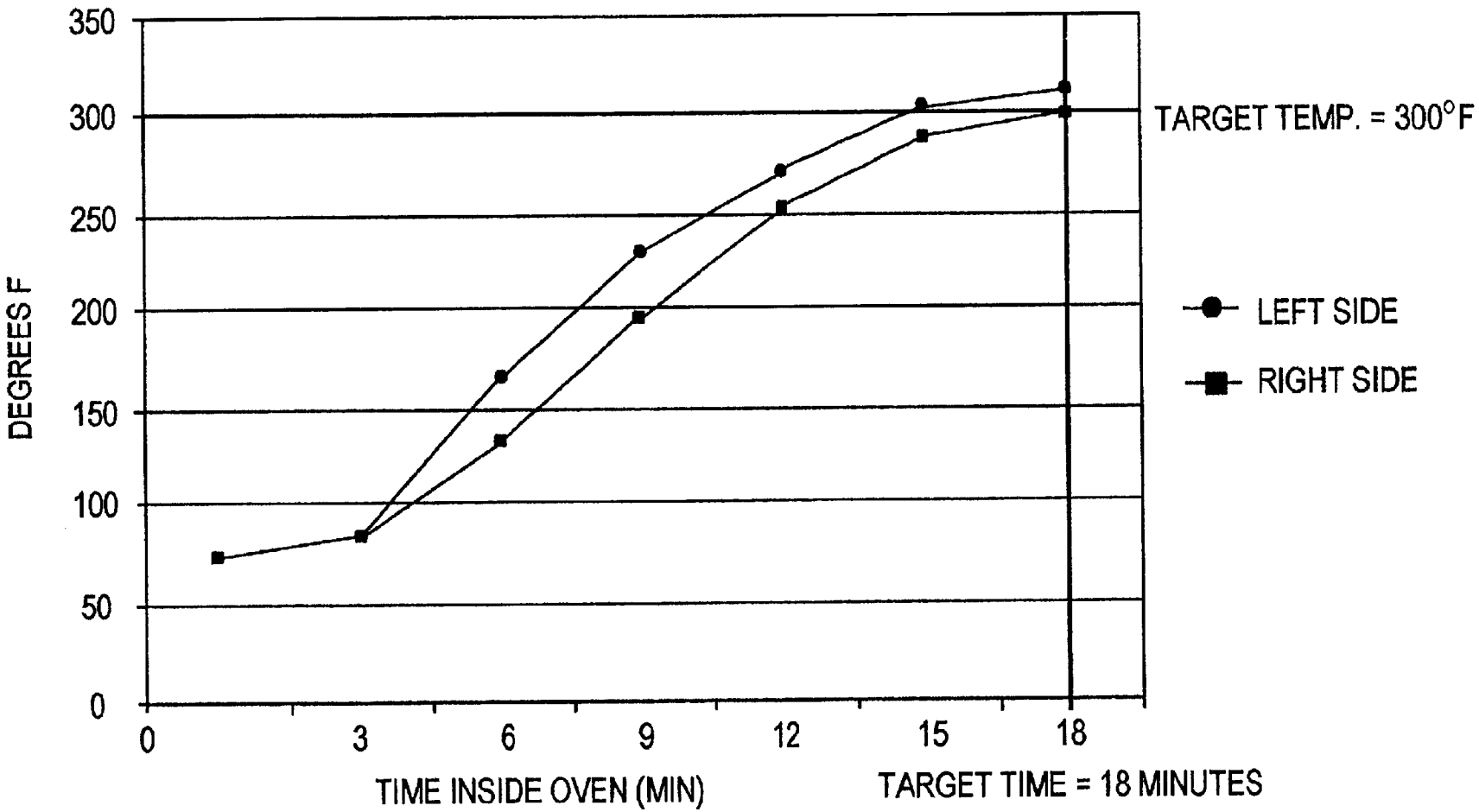
FIG. 3 is a graph of a typical measured temperature between the top and bottom setters corresponding to location of the green ceramic core on right and left hand sides of the conveyor as the setters are conveyed through the heating oven.

For example, referring to FIG. 3, the temperature in the cavity (empty cavity) between first and second pairs of setters 40, 42 in which a core 10 will be received was measured as the setters 40, 42 were conveyed side-by-side through the oven 52 at a preselected conveyor speed (e.g. 2 inches per minute) and at an internal oven temperature of 300 degrees F. A pair of setters 40, 42 was positioned on the left hand side of conveyor 50 while another pair of setters 40, 42 was positioned on the right hand side of the conveyor 50. The temperature in the empty cavity defined between each pair of setters 40, 42 was measured by a respective thermocouple placed in each empty cavity between the respective first and second pairs of setters 40, 42 positioned on the left hand side (see solid black circle temperature data points) and right hand side (see solid black square temperature data points) of the conveyor 50 and thus oven 52. FIG.

3 shows that the temperature in each empty cavity between the respective pairs of setters 40, 42 increases with time as the setters are conveyed through the oven 52 until a "target" temperature of 300 degrees F. is reached after 18 minutes and corresponding to the setters 40, 42 being located proximate the exit opening 52*b* of the oven 52.

For a given oven internal temperature, the conveyor speed is controlled to achieve the desired superambient annealing temperature of the green core 10 proximate exit opening 52*b* of the heating oven. The particular conveyor speed used will depend on the temperature characteristics of the oven 52, the mass and thermal conductivity of the core 10 and setters 40, 42 and can be determined empirically to provide the desired superambient temperature proximate exit opening 52*b* of the heating oven.

The target temperature of 300 degrees F. for the green core 10 between the setters 40, 42 mentioned above is offered only for purposes of illustration and was selected for the above-noted thermosetting resin core binder (i.e. SR 360 binder available from General Electric Company) and having a softening temperature above about 200 degrees F. (e.g. approximately 250 degrees F.) after the green ceramic core is molded. Other target annealing temperatures would be selected for different organic binders with different softening temperatures when the binder is present in the molded green ceramic core.

After the setters 40, 42/core 10 exit from the oven 52 through opening 52*b*, they are removed from the conveyor 50 and placed on a table 54 so that the setters 40, 42/core 10 can cool to ambient temperature. The heated setters 40, 42 serve as heat suppliers to supply heat to the green ceramic core 10 therebetween on table 54. Use of the setters 40, 42 allows the core 10 to be formed to proper shape while being held at elevated superambient temperature longer as the setter mass cools.

Heating of the green ceramic cores 10 in the manner described above helps to conform the green core 10 to surfaces 40*a*, 42*a* of the setters 40, 42 to reduce distortion of the core, relax core internal stresses and substantially improve the yield of green cores that are within preselected dimensional tolerances.

The invention is not limited to heating the setters 40, 42/core 10 to the desired superambient temperature proximate exit opening 52*b* of the heating oven. For example, the setters 40, 42/core 10 can be heated to the superambient temperature above the softening temperature of the binder at any location or position within the heating oven 52 as they are being conveyed through the oven 52 on conveyor 50. However, heating of the setters 40, 42/core 10 to the desired superambient temperature proximate exit opening 52*b* of the heating oven is advantageous and preferred to reduce the residence time of the setters 40, 42/core 10 in the oven 52.

It will be apparent to those skilled in the art that variations can be made in the embodiments of the invention described without departing from the scope of the invention set forth in the claims.

What is claimed is:

1. A method of treating a ceramic core after molding and before firing for use in casting molten metallic material, comprising placing an unfired ceramic core having a molded core shape and having an organic binder on at least one setter, placing said at least one setter and said unfired ceramic core thereon on a conveyor that conveys said at least one setter and said unfired core through a heating oven, conveying said at least one setter and said unfired ceramic core through the heating oven to heat said at least one setter and said unfired ceramic core to an elevated temperature at or above a softening temperature of said binder effective to soften said binder to reduce distortion of said unfired ceramic core, and removing said at least one setter and said unfired ceramic core having softened organic binder from said oven to cool to ambient temperature.

2. The method of claim 1 including controlling the rate of travel of the conveyor such that said at least one setter and said unfired ceramic core are heated to said elevated temperature when they are located proximate an exit opening of the heating oven.

3. The method of claim 1 wherein said at least one setter supplies heat to said unfired ceramic core after removal from the heating oven and during cooling to ambient temperature.

4. The method of claim 1 wherein said unfired ceramic core conforms to a surface of said at least one setter by being heated to said elevated temperature.

5. The method of claim 1 wherein said unfired ceramic core is placed between a top setter and a bottom setter and is conveyed through the heating oven between the top setter and bottom setter.

6. The method of claim 1 wherein said unfired ceramic core includes an airfoil region.

7. The method of claim 1 wherein the binder comprises a thermosetting binder.

8. The method of claim 1 wherein the binder comprises a thermoplastic binder.

9. A method of treating a ceramic core after molding and before firing for use in casting molten metallic material, comprising a) heating an unfired ceramic core having a molded core shape and having an organic binder on at least one setter in a heating oven to an elevated temperature at or above a softening temperature of said binder effective to soften said binder to reduce distortion of said unfired ceramic core and b) removing said at least one setter and said unfired ceramic core having softened organic binder from said oven to cool to ambient temperature.

10. The method of claim 9 wherein the said unfired ceramic core includes an airfoil region.

* * * * *